US011224281B2

(12) United States Patent
Dengler et al.

(10) Patent No.: US 11,224,281 B2
(45) **Date of Patent: *Jan. 18, 2022**

(54) BRUSH HEAD ARRANGEMENTS

(71) Applicant: KONINKLIJKE PHILIPS N.V., Eindhoven (NL)

(72) Inventors: Evan Dak Wah Dengler, Seattle, WA (US); Satya Rajagopalan, Bothell, WA (US)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 16/942,903

(22) Filed: Jul. 30, 2020

(65) Prior Publication Data

US 2020/0352313 A1 Nov. 12, 2020

Related U.S. Application Data

(63) Continuation of application No. 15/573,249, filed as application No. PCT/IB2016/052647 on May 10, 2016, now Pat. No. 10,750,847.

(60) Provisional application No. 62/161,355, filed on May 14, 2015.

(51) Int. Cl.

| | |
|---|---|
| ***A46D 3/00*** | (2006.01) |
| ***A46B 9/04*** | (2006.01) |
| ***A46B 3/10*** | (2006.01) |
| ***A46B 3/20*** | (2006.01) |

(Continued)

(52) U.S. Cl.

CPC ..... *A46B 3/10* (2013.01); *A46B 3/06* (2013.01); *A46B 3/20* (2013.01); *A46D 3/045* (2013.01); *A46B 9/04* (2013.01); *A46B 2200/1066* (2013.01)

(58) Field of Classification Search

CPC ..... A46B 9/04; A46B 3/20; A46B 5/0029; A46D 3/00

See application file for complete search history.

(56) References Cited

U.S. PATENT DOCUMENTS

| | | | | |
|---|---|---|---|---|
| 3,082,457 A * | 3/1963 | Lucibello | ..... | A46B 5/0029 15/167.1 |
| 5,474,366 A | 12/1995 | Zahoransky et al. | | |
| 5,802,656 A | 9/1998 | Dawson et al. | | |

(Continued)

FOREIGN PATENT DOCUMENTS

| | | |
|---|---|---|
| CN | 1949998 A | 4/2007 |
| CN | 101568275 A | 10/2009 |

(Continued)

*Primary Examiner* — Michael D Jennings

(57) ABSTRACT

A brush head (32) including: a plurality of bristle tufts (21), each of which comprises a plurality of bristle strands having a free end (25) and a proximal end (23); a plurality of retention rings (50) each comprising an upper portion (51), a lower portion (53), an exterior wall (55) and an interior wall (57), and each configured to receive the proximal end of at least one of the plurality of bristle tufts, wherein at least one of the plurality of retention rings comprises a transverse projection (71, 72) extending from the exterior and/or interior wall of the retention ring; and an elastomeric matrix (30) comprising at least a portion of each of the plurality of retention rings and the proximal end of each of the plurality of bristle tufts.

8 Claims, 6 Drawing Sheets

(51) Int. Cl.
*A46D 3/04* (2006.01)
*A46B 3/06* (2006.01)

(56) References Cited

U.S. PATENT DOCUMENTS

| | | | | |
|---|---|---|---|---|
| 5,970,564 | A | 10/1999 | Inns et al. | |
| 6,088,870 | A | 7/2000 | Holbein | |
| 6,311,360 | B1 | 11/2001 | Lanvers | |
| 6,406,099 | B2 | 6/2002 | Boucherie | |
| 7,281,768 | B2 | 10/2007 | Sato et al. | |
| 7,600,288 | B1 | 10/2009 | Givonetti | |
| 7,992,247 | B2 | 8/2011 | Pfenniger et al. | |
| 8,069,524 | B2 | 12/2011 | Kraemer | |
| 8,099,819 | B2 | 1/2012 | Kraemer | |
| 8,132,284 | B1 * | 3/2012 | Kraemer | A46B 7/06 15/167.1 |
| RE45,141 | E * | 9/2014 | Fischer | A46D 1/00 15/110 |
| 2001/0024060 | A1 * | 9/2001 | Boucherie | A46B 3/04 300/21 |
| 2001/0038237 | A1 | 11/2001 | Boucherie | |
| 2003/0041402 | A1 | 3/2003 | Stein et al. | |
| 2007/0006410 | A1 | 1/2007 | Kraemer | |
| 2007/0271717 | A1 | 11/2007 | Clos | |
| 2008/0168613 | A1 | 7/2008 | Kraemer | |
| 2011/0258798 | A1 | 10/2011 | Naftal | |
| 2012/0233790 | A1 | 9/2012 | Uchida et al. | |
| 2014/0232173 | A1 | 8/2014 | Birk et al. | |

FOREIGN PATENT DOCUMENTS

| | | | |
|---|---|---|---|
| EP | 1593321 | A1 | 11/2005 |
| EP | 2708155 | A1 | 3/2014 |
| JP | 2009022560 | A | 2/2009 |
| KR | 20100133076 | A | 12/2010 |
| WO | 2004080238 | A1 | 9/2004 |
| WO | 2006012956 | A2 | 2/2006 |
| WO | 2006109077 | A1 | 10/2006 |
| WO | 200803458 | A1 | 3/2008 |

* cited by examiner

BRUSH HEAD ARRANGEMENTS

CROSS-REFERENCE TO PRIOR APPLICATIONS

This application is a continuation of U.S. application Ser. No. 15/573,249, filed on Nov. 10, 2017, which is a U.S. National Phase application under 35 U.S.C. § 371 of International Application No. PCT/162016/052647, filed on May 10, 2016, which claims the benefit of U.S. Provisional Patent Application No. 62/161,355, filed on May 14, 2015. These applications are hereby incorporated by reference herein.

FIELD OF THE INVENTION

The present disclosure is directed generally to a brush head assembly with a plurality of bristle tufts, and more particularly, to the arrangement, structure, and securement of bristle tufts in the brush head assembly.

BACKGROUND

Periodontal diseases are thought to be infectious diseases caused by bacteria present in dental plaques. Tooth brushing is a highly effective method to remove dental plaque from the teeth. Power toothbrushes can enhance the removal of dental plaque. Such power toothbrushes have a set of bristles attached to a brush head which is moved by a driver that causes the bristles to scrub dental surfaces.

The brush heads of both manual and power toothbrushes comprise bristles which are used to clean the teeth, tongue, and cheeks. In some toothbrushes, the bristles are organized into bristle tufts contained within retention rings. The retention rings serve to secure the bristle tufts within the brush head and often have a hollow circular shape with an interior and exterior circular circumference. During manufacture, the bristle tufts are inserted into the hollow interior of the retention ring, and the bristles in the retention ring are then secured into a brush head material which is then cooled or allowed to cool in order to form the final brush head.

Often, however, the retention rings are not firmly secured within the brush head. As a result, the ring and bristle tuft can be or become loose within the brush head, and the bristles might not always be positioned at an angle optimal for brushing. As such, under the dynamic conditions of motion induced by the power toothbrush operation, for example, the bristle tuft structure can undergo higher stresses under the dynamic motion, which could lead to separation. Further, the process of organizing the bristles into tufts within the retention rings and then cooling the brush head material, or allowing it to cool, in order to fix the tufts in place can be time-consuming and expensive.

Accordingly, there is a need in the art for brush head assemblies that permanently and efficiently retain bristle tufts within the brush head.

SUMMARY OF THE INVENTION

The present disclosure is directed to inventive methods for a brush head assembly with secured bristle tufts. Various embodiments and implementations herein are directed to brush head assemblies in which bristle tufts are affixed with retention rings and are then embedded within an elastomeric matrix resulting in a completed brush head. Using the various embodiments and implementations herein, retention of bristle tufts within brush heads is substantially improved. For example, in some embodiments, the exterior wall of a retention ring can include a transverse projection to provide better adhesion of the retention ring in the elastomeric matrix. The main pull out mechanism of the tuft typically occurs with delamination in the elastomeric matrix-retention ring bond, so increasing the surface area can be critical to improved retention. In other embodiments, the proximal end head portion of two or more of the bristle tufts can be joined together to improve retention.

Generally in one aspect, a brush head is provided. The brush head includes: a plurality of bristle tufts, each of which comprises a plurality of bristle strands having a free end and a proximal end; a plurality of retention rings each comprising an upper portion, a lower portion, an exterior wall and an interior wall, and each configured to receive the proximal end of at least one of the plurality of bristle tufts, wherein at least one of the plurality of retention rings comprises a transverse projection extending from the exterior and/or interior wall of the retention ring; and an elastomeric matrix comprising at least a portion of each of the plurality of retention rings and the proximal end of each of the plurality of bristle tufts.

According to an embodiment, the transverse projection extends from the exterior wall of the retention ring and is configured to engage the elastomeric matrix.

According to an embodiment, the transverse projection comprises a screw-like transverse projection extending from the upper portion to the lower portion of the retention ring.

According to an embodiment, the transverse projection extends from the interior wall of the retention ring and is configured to engage a bristle tuft received by the retention ring.

According to an embodiment, the transverse projection comprises a screw-like transverse projection extending from the upper portion to the lower portion of the retention ring.

According to an embodiment, the retention rings comprise both a transverse projection extending from the exterior and a transverse projection extending from the interior wall of the retention ring.

According to an embodiment, each of the plurality of retention rings comprises a plurality of transverse projections.

According to an aspect is a brush head assembly. The brush head assembly includes a neck and a brush head, the brush head including: a plurality of bristle tufts, each of which comprises a plurality of bristle strands having a free end and a proximal end; a plurality of retention rings each comprising an upper portion, a lower portion, an exterior wall and an interior wall, and each configured to receive the proximal end of at least one of the plurality of bristle tufts, wherein at least one of the plurality of retention rings comprises a transverse projection extending from the exterior and/or interior wall of the retention ring; a brush neck positioned relative to the plurality of proximal end head; and an elastomeric matrix comprising at least a portion of the plurality of retention rings, the proximal end head portions of each of the plurality of bristle tufts, and the brush neck.

According to an aspect is a method for manufacturing a brush head. The method includes the steps of: providing a plurality of retention rings each comprising an upper portion, a lower portion, an exterior wall and an interior wall, and each configured to receive the proximal end of at least one of a plurality of bristle tufts, wherein at least one of the plurality of retention rings comprises a transverse projection extending from the exterior and/or interior wall of the retention ring; providing the plurality of bristle tufts, wherein each of the plurality of bristle tufts comprises a plurality of bristle strands having a free end and a proximal end; inserting at least one of the plurality of bristle tufts into a respective one of the plurality of the retention rings; applying heat to each of the bristle tuft proximal ends at a temperature and distance sufficient to at least partially melt the bristle tuft proximal end to create a proximal end head portion; and positioning a brush neck in relation to the proximal end head portions; and injecting a thermoplastic elastomer to create an elastomeric matrix that at least partially encompasses the brush neck, the plurality of retaining rings, and the proximal end head portions.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

These and other aspects of the invention will be apparent from and elucidated with reference to the embodiment(s) described hereinafter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION OF EMBODIMENTS

The present disclosure describes various embodiments of a brush head assembly with bristle tufts retained within retention rings within an elastomeric matrix. More generally, Applicants have recognized and appreciated that it would be beneficial to provide a brush head formed with bristles embedded in an elastomeric matrix in order to improve bristle retention. Providing a retention ring with one or more transverse projections results in better adhesion of the retention ring within the elastomeric matrix. Additionally, joining together the proximal end head portion of two or more of the bristle tufts improves retention of the bristle tufts within the brush head assembly, especially in powered toothbrush devices. A particular goal of utilization of certain embodiments of the present disclosure is the ability to create brush head assemblies in which bristle tufts are more efficiently retained within the brush head.

The brush heads disclosed and described herein can be used with any manual or power toothbrush device. One example of a power toothbrush device that the brush head can be used with Sonicare® devices available from Koninklijke Philips Electronics N.V. This oral care device is based upon an actuator with a reciprocating brush head including bristles to provide an effective cleaning of a user's teeth.

Figure 1:
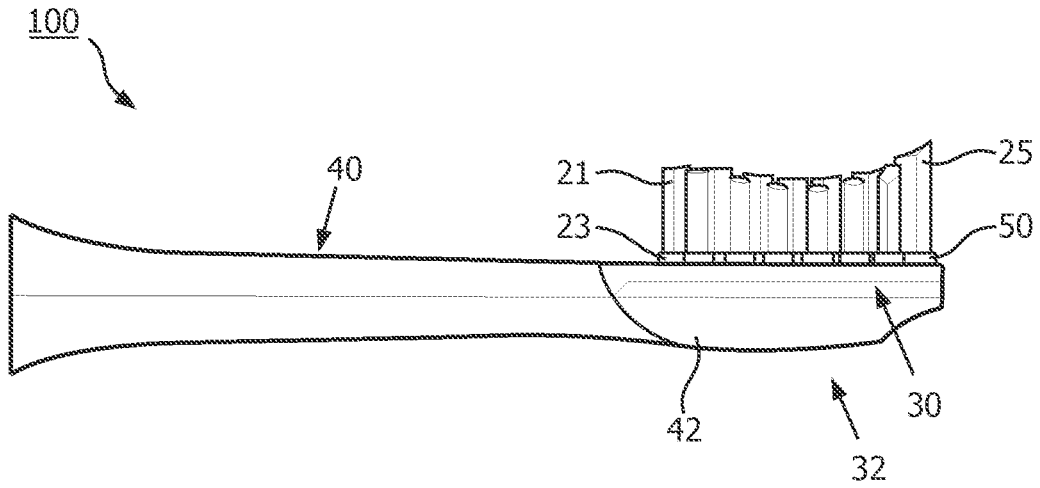
FIG. 1 is a schematic representation of a brush head assembly in accordance with an embodiment.

Referring to FIG. 1, in one embodiment, a schematic representation of a brush head assembly 100 is provided. The brush head assembly includes a neck 40, which can be coupled to any manual brush shaft, or, more preferably, to any actuator and drive shaft (not shown) made or suitable for oral care devices now known or to be developed. The brush head 32 of the brush head assembly includes a plurality of bristle tufts 21, each of which comprises a plurality of bristle strands. According to an embodiment, the bristle tufts are composed of nylon, or another suitable material, and optionally can be coated with polyurethane, polybutylene terephthalate (PBT), polyolefin, combinations of these, or a similar polymer. Each bristle tuft includes a proximal end 23 and a free end 25, where the proximal end of each bristle tuft is retained within the brush head assembly 100. Each bristle tuft 21 is retained within a respective one of a plurality of retention rings 50. The proximal end of the bristle tuft and the retention rings and the supporting portion 42 of the brush neck 40 are retained within a flexible elastomeric matrix 30 to form a head portion 32 of the brush head assembly 100. According to an embodiment, the elastomeric matrix 30 is preferably made from a flexible thermoplastic elastomer (TPE), and the retention rings are preferably made from thermoplastic polymer such as polypropylene. Each of the brush neck 40, supporting portion of the brush neck 42, and the retention rings 50 is preferably made from a material with a higher elastic modulus value than the elastomeric matrix 30, although many different configurations are possible.

Figure 2:
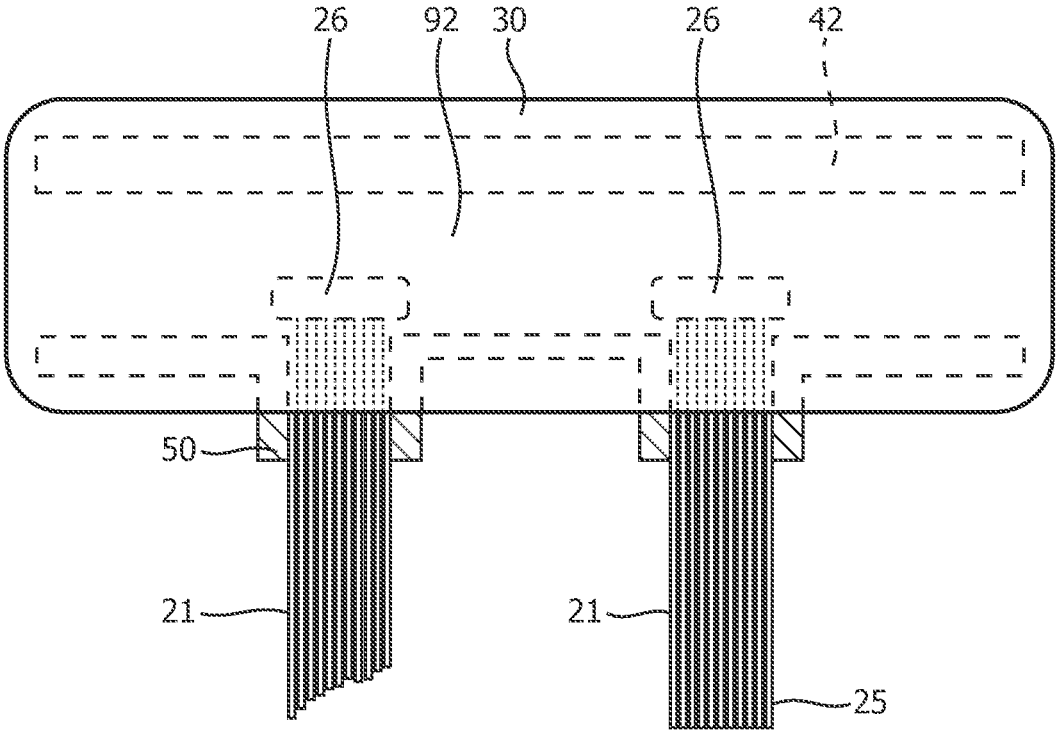
FIG. 2 is a schematic representation of a portion of a brush head assembly in accordance with an embodiment.
Figure 4:
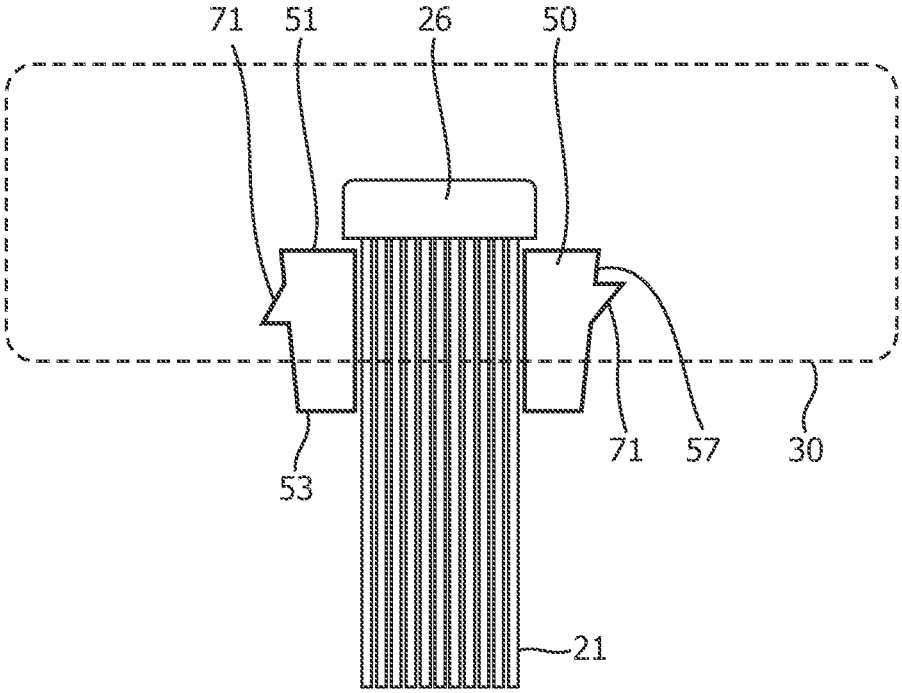
FIG. 4 is a schematic representation of a portion of a brush head assembly in accordance with an embodiment.

Referring to FIG. 2, in one embodiment, is a cut-away view of a portion of the brush head 32. Each of the bristle tufts 21 is surrounded by a retaining ring 50, or a portion of a retaining ring 50, and each has a free end 25 and a proximal end 23 with a head portion 26. According to an embodiment, a plurality of retention rings 50 is provided. Retention rings 50 can be of a plurality of shapes, sizes, configurations or tapers. For example, the retention rings 50 can optionally be connected or at least partially interconnected by a webbing or network of webbing links 91 to improve retention ring and bristle tuft retention within the brush head (as shown in FIG. 4), although a webbing link is not necessary and a plurality of individual retention rings 50 can be used. It can be appreciated that while the retaining rings 50 shown in the figures herein are shown as straight cylinders for the sake of simplicity, they can be a variety of different shapes both inside and outside (pentagons, squares, etc.) and have various tapers or partial tapers to the inside and outside of the retaining rings, and retaining rings of various shapes can be used together in a single brush head.

An elastomeric material is formed around the supporting portion of the brush neck 42, the proximal end head portion 26 of the bristle tufts 21, all or a portion of the retaining rings 50, as well as the webbing links 91 if they are present. The elastomeric material forms an elastomeric matrix 30 that fills in the space 92 between the supporting portion of the brush neck 42 and the proximal end head portion 26. According to an embodiment, elastomeric matrix 30 is preferably made from a flexible thermoplastic elastomer, while the retaining rings are preferably made from thermoplastic polymer such as polypropylene. According to this embodiment, each of the brush neck 40 and the retaining rings 50 is made from a material with a higher elastic modulus than the elastomeric matrix 30. As a result there is flexible elastomeric matrix between the retaining head and the tuft ring. This additional layer of elastomeric matrix between the retaining head and the tuft ring can be compressed during operation, such that when the bristle tuft is being pulled downward toward the free end of the bristles the matrix absorbs some of the pressure, and the force is distributed throughout the elastomeric matrix. This results in greater flexibility of tuft movement, and also, by reducing the pressure, reduces the probability of the retaining head breaking through the retaining ring.

Figure 3:
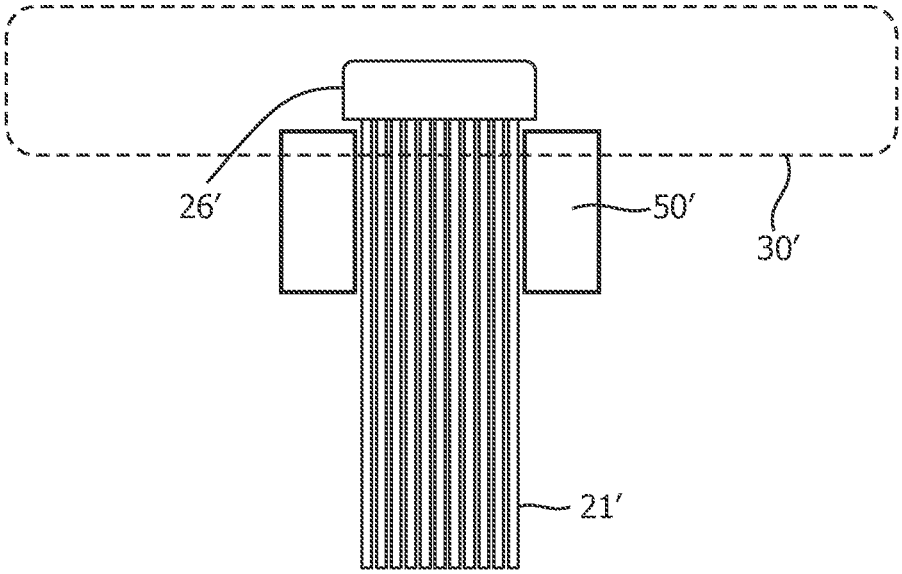
FIG. 3 (Prior Art)
FIG. 3 is a schematic representation of a portion of a prior art brush head assembly.

Referring to FIG. 3 is a cutaway side view of a prior art bristle tuft 21' with a retention ring 50'. The bristle tuft 21' is inserted into and surrounded by a retaining ring 50', or a portion of a retaining ring 50'. The retaining ring 50' has a cylindrical straight interior wall and a straight exterior wall without any transverse projections on either the interior wall or the exterior wall. The proximal end head portion 26' of the bristle tuft 21' is retained with an elastomeric matrix 30', and also helps prevent the bristle tuft from being pulled out of the elastomeric matrix and retaining ring. However, with moderate force the bristle tuft can still be pulled from the elastomeric matrix and retaining ring, resulting in bristle tuft loss.

Referring to FIG. 4, in one embodiment, is a cutaway side view of a bristle tuft 21 in a retention ring 50 and comprising a proximal end head portion 26, embedded in an elastomeric matrix 30. The retention ring 50 comprises an upper portion 51, a lower portion 53, and an exterior wall 57. According to an embodiment, the exterior wall 57 of the retention ring 50 comprises at least one transverse projection 71 extending outwardly therefrom. The transverse projection 71 can take many different forms and configurations. Referring to FIG. 4, for example, transverse projection 71 is an angled projection that points upward, while transverse projection 71 is an angled projection that points downward. These transverse projections can be positioned anywhere along the retention ring, including nearer to the upper portion 51, near to the lower portion 53, equidistant between the lower and upper portions, and a combination of all three positions. As shown in FIG. 4, for example, the transverse projections 71 provide better adherence of the retention ring in the elastomeric matrix 30. It would require greater force, for example, to pull the retention ring from the elastomeric matrix due to the one or more transverse projections 71.

Figure 5:
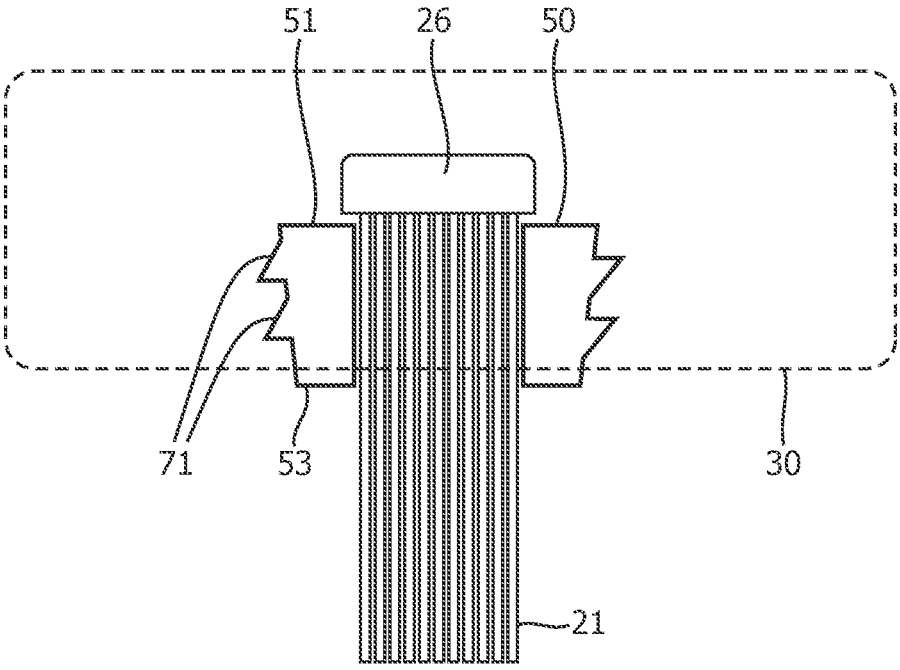
FIG. 5 is a schematic representation of a portion of a brush head assembly in accordance with an embodiment.

Referring to FIG. 5, in one embodiment, is a cutaway side view of a bristle tuft 21 in a retention ring 50 and comprising a proximal end head portion 26, embedded in an elastomeric matrix 30. In this embodiment, the exterior wall 57 of the retention ring 50 comprises several transverse projections 71 located at several different locations along the wall. These transverse projections are embedded in the elastomeric matrix 30 and help prevent loss of the retention ring and/or bristle tuft from the elastomeric matrix.

Figure 6:
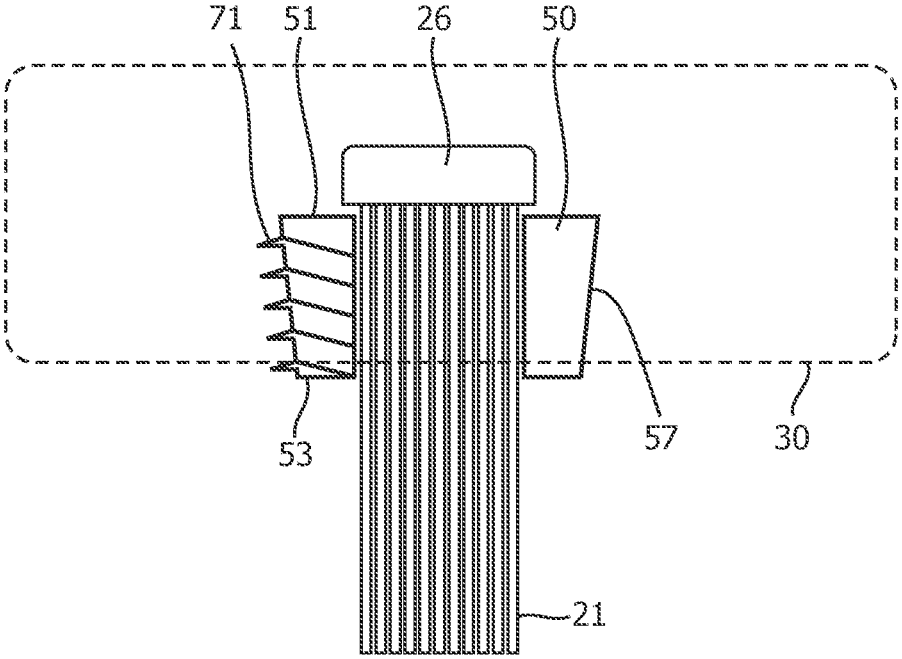
FIG. 6 is a schematic representation of a portion of a brush head assembly in accordance with an embodiment.

Referring to FIG. 6, in one embodiment, is a cutaway side view of a bristle tuft 21 in a retention ring 50 and comprising a proximal end head portion 26, embedded in an elastomeric matrix 30. In this embodiment, a transverse projection 71 of the retention ring comprises a screw-thread like helical projection projecting outwards along the length of the exterior wall 57 from the upper portion 51 to the lower portion 53.

Figure 7A:
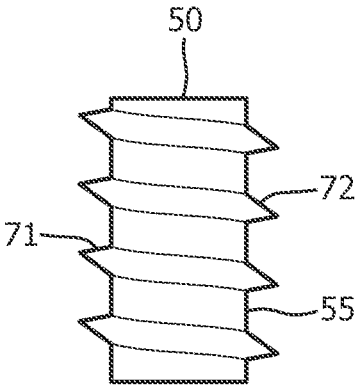
FIG. 7A is a schematic representation of a retention ring in accordance with an embodiment.
Figure 7B:
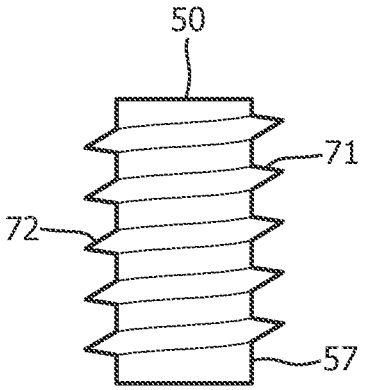
FIG. 7B is a schematic representation of a retention ring in accordance with an embodiment.
Figure 8A:
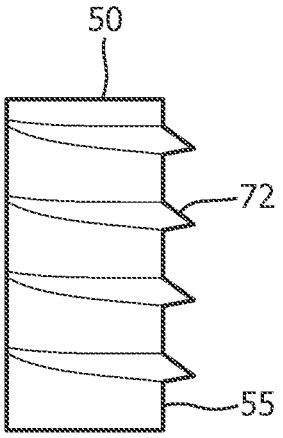
FIG. 8A is a schematic representation of a retention ring in accordance with an embodiment.
Figure 8B:
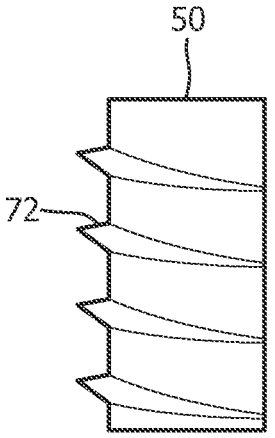
FIG. 8B is a schematic representation of a retention ring in accordance with an embodiment.

Referring to FIGS. 7A-B and 8A-B are schematic representations of various embodiments of a retention ring 50. In FIGS. 7A and 7B, both the interior wall 55 and the exterior wall 57 of the retention ring include a transverse projection extending along at least part of the wall. In FIG. 7A, the transverse projection is a slightly-angled screw-thread like helical projection wrapping around the entire wall of the retention ring. Accordingly, each transverse projection (or each length of the transverse projection) comprises a projection 71 from the exterior wall 57 of the retention ring, and a projection 72 from the interior wall 55 of the retention ring. In FIG. 7B, the transverse projection wraps around the entire wall of the retention ring, with a portion 71 projecting outward from the retention ring's central longitudinal axis, and a portion 72 projecting inward toward the retention rings central longitudinal axis. This embodiment, for example, interacts with both the bristle tuft 21 and the elastomeric matrix 30 when the brush head is assembled. In FIGS. 8A and 8B, the retention ring 50 has a transverse projection 72 on only the interior wall 55 thereof for improved securement of the bristle tuft 21 (not shown) in the retention ring 50.

According to an embodiment, the internal transverse projection 72 in FIGS. 7A through 8B could facilitate bristle retention in a brush configuration in which the bristles are made of a softer material with a high coefficient of friction, such as a compressible rubber, and the tuft ring material is made of a harder material with a rough surface. According to this embodiment, the interior transverse projection 72 would act like a collet or collar to grip or hold onto the bristles.

Figure 9:
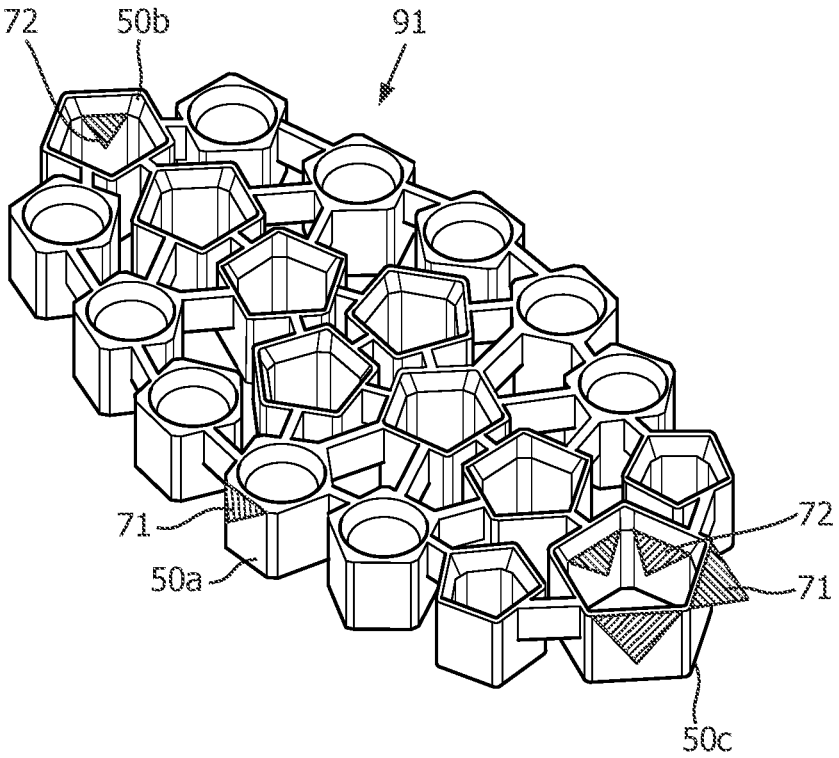
FIG. 9 is a schematic representation of a retention ring network in accordance with an embodiment.

Referring to FIG. 9, in one embodiment, is a schematic representation of an optional webbing network 91 of retention rings 50 (50*a*, 50*b*, 50*c*, . . . ). One or more of the retention rings in the network comprise one or more of the following: transverse projection(s) 71 extending outwardly from the exterior wall of the retention ring, transverse projection(s) 72 extending inwardly from the interior wall of the retention ring, and/or both transverse projection(s) 71 and transverse projection(s) 72. Many other configurations are possible.

While the retention rings might be shown as straight, cylindrical shapes for the purposes of simplicity, it should be appreciated that the retaining rings can have varying interior and exterior shapes (including but not limited to circular, square, hexagonal, and many others), and one or more of the interior or exterior of the retaining rings can be tapered in varying directions and angles, the same or different ways, along part of all of the length of the retaining rings.

Figure 10:
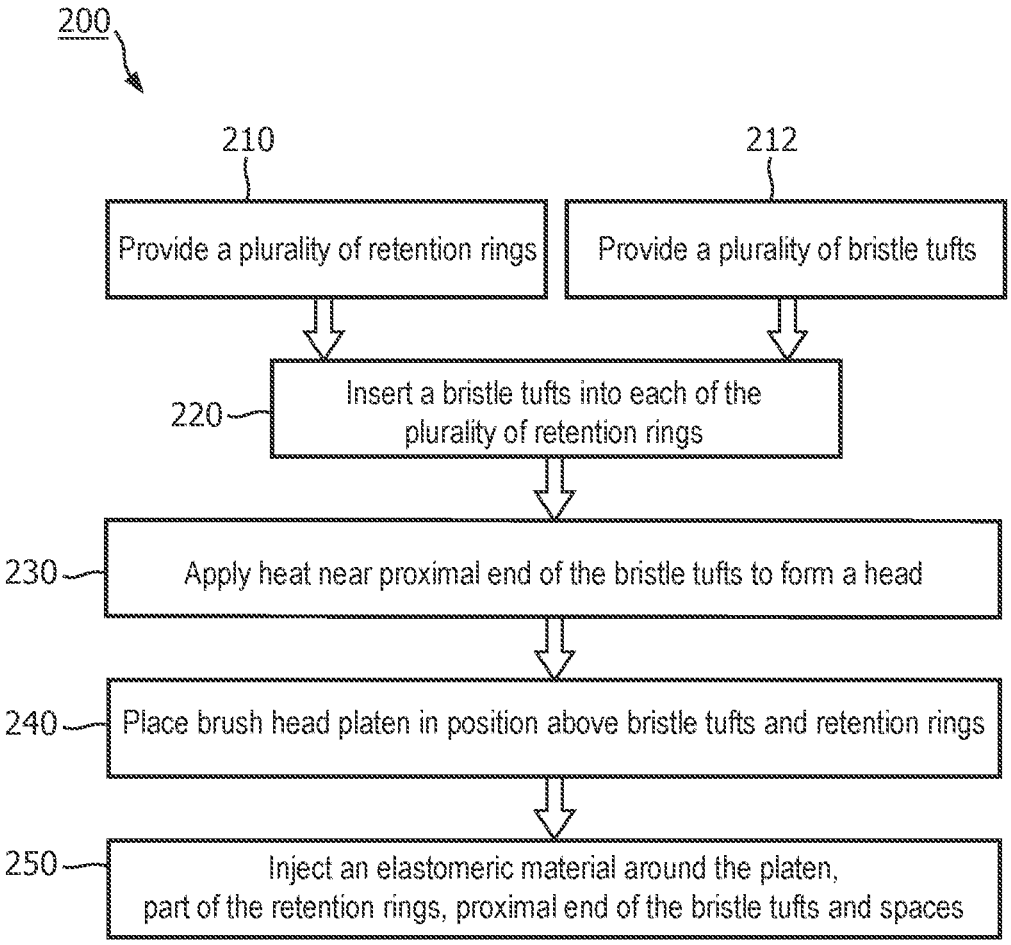
FIG. 10 is a flowchart of a method for manufacturing a brush head assembly with bristle tufts retained within an elastomeric matrix in accordance with an embodiment.

Referring to FIG. 10, in one embodiment, is a flowchart depicted a method 200 for manufacturing a brush head 32. The brush head can be any of the brush heads described or otherwise envisioned herein. For example, brush head 32 can comprise a plurality of bristle tufts 21, each retained within a retention ring 50, where the proximal end of each bristle tuft is retained within a flexible elastomeric matrix 30 to form a head portion 32 of the brush head assembly 100.

In step 210 of the method, a plurality of retention rings 50 is provided. According to an embodiment, the retention rings can be made from thermoplastic polymer such as polypropylene. The retention rings 50 ban be made from a material with a higher elastic modulus value than, for example, the elastomeric matrix 30. The retention rings can be of a plurality of shapes, sizes, configurations, or tapers. According to an embodiment, the retention rings are connected or at least partially interconnected by a webbing network 91 of retention rings to improve retention ring and bristle tuft retention within the brush head. According to an embodiment, one or more of the retaining rings 50 in the brush head 32 comprise one or more transverse projections 71 extending inwardly from the interior wall of the retention ring to engage the elastomeric matrix 30, and/or one or more transverse projections 72 extending inwardly from the interior wall of the retention ring to engage the bristle tuft 21.

In step 212 of the method, a plurality of bristle tufts 21 each comprising a plurality of bristle strands is provided. Each bristle tuft includes a proximal end 23 and a free end 25, where the proximal end of each bristle tuft is retained within the brush head assembly 100.

In step 220 of the method, each of the plurality of bristle tufts 21 is inserted into a respective one of the plurality of retention rings 50. This can be, for example, an automated process in which bristle tufts are sequentially inserted into the retention rings, are inserted into the retention rings in a random order, or are simultaneously inserted into the retention rings. The bristles of the bristle tufts may be inserted to comprise different heights and different angles, and can vary among a single bristle tuft or between different bristle tufts.

At step 230 of the method, heat is applied near the proximal end 23 of the plurality of bristle tufts 21 to create a proximal end head portion 26 on each of the tufts 21. Proximal end head portion 26 is the melted ends of the bristle tuft 21. The heat can be supplied by a heat source that comes into direct physical contact with the proximal end 23 of the bristle tufts, or the heat can be supplied by heated air or any of a variety of other heat sources. As one example, a hot instrument can be moved across the brush head at or near the proximal end 23 of the plurality of bristle tufts. The distance between the hot instrument and the proximal end can be determined, for example, by a variety of factors, including but not limited to, the materials of the bristles and retention rings, the temperature of the hot instrument, the moving speed of the hot instrument and the material of the hot instrument. The optimal factors will achieve melting of the bristle tufts 21 to form a proximal end head portion 26.

In step 240 of the method, the brush neck 40 can be positioned to put the supporting portion of the brush neck 42 in the proper location in relation to the retaining rings 50 and the bristle tufts 21. The supporting portion of the brush neck 42 is positioned relative to the bristle tufts and retention rings such that a space 92 is created, as shown in FIG. 2. The supporting portion of the brush neck 42 can be properly positioned using a mold, for example, or other positioning mechanism. Notably, step 240 can be performed at any point during the method prior to step 250. According to an embodiment, the supporting portion of the brush neck 42 can be designed to promote fusing of the elastomeric matrix to the brush neck. For example, if the brush neck and supporting portion of the brush neck, is made from materials such as Spandex®, PolyMeg®, or similar copolymers, this would allow fusing of the elastomer matrix to the brush neck, thereby increasing retention forces. In addition, this design provides additional flexibility to the bristle tuft within the brush neck, and therefore additional degrees of freedom of motion within the brush head. However, many other materials and configurations for the brush neck 40 are possible.

At step 250 of the method, an elastomeric material is molded over at least a portion of the supporting portion of the brush neck 42, the head portion 26 of the bristle tufts, and the retaining rings 50. The molded elastomeric material forms an elastomeric matrix 30 that also fills in the space 92 between the supporting portion of the brush neck 42 and the proximal end head portion 26, as shown in FIG. 2. According to an embodiment, elastomeric matrix 30 is preferably made from a flexible thermoplastic elastomer.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of" or "exactly one of."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

What is claimed is:

1. A brush head assembly for a power toothbrush, comprising:

a neck; and a brush head, the brush head comprising:

a plurality of bristle tufts, each of which comprises a plurality of bristle strands having a free end and a proximal end;

a plurality of retention rings each comprising an upper portion, a lower portion, an exterior wall and an interior wall, and each configured to receive the proximal end of at least one of the plurality of bristle tufts, wherein at least one of the plurality of retention rings comprises a transverse projection extending from the exterior or the interior wall of the retention ring;

a supporting portion of brush neck positioned relative to the plurality of proximal end head; and an elastomeric matrix comprising at least a portion of the plurality of retention rings, the proximal end head portions of each of the plurality of bristle tufts, and the supporting portion of the brush neck.

2. The brush head assembly of claim 1, wherein the transverse projection extends from the exterior wall of the retention ring and is configured to engage the elastomeric matrix.

3. The brush head assembly of claim 1, wherein the transverse projection extends from the interior wall of the retention ring and is configured to engage a bristle tuft received by the retention ring.

4. The brush head assembly of claim 1, wherein the at least one of the plurality of retention rings comprises both a transverse projection extending from the exterior and a transverse projection extending from the interior wall of the retention ring.

5. The brush head assembly of claim 1, wherein each of the plurality of retention rings comprises a plurality of transverse projections.

6. A method for manufacturing a brush head, the method comprising the steps of:

providing a plurality of retention rings each comprising an upper portion, a lower portion, an exterior wall and an interior wall, and each configured to receive the proximal end of at least one of a plurality of bristle tufts, wherein at least one of the plurality of retention rings comprises a transverse projection extending from the exterior or the interior wall of the retention ring;

providing the plurality of bristle tufts, wherein each of the plurality of bristle tufts comprises a plurality of bristle strands having a free end and a proximal end;

inserting at least one of the plurality of bristle tufts into a respective one of the plurality of the retention rings;

applying heat to each of the bristle tuft proximal ends at a temperature and distance sufficient to at least partially melt the bristle tuft proximal end to create a proximal end head portion; and positioning a supporting portion of brush neck in relation to the proximal end head portions; and injecting a thermoplastic elastomer to create an elastomeric matrix that at least partially encompasses the brush neck, the plurality of retaining rings, and the proximal end head portions.

7. The method of claim 6, wherein the transverse projection extends from the exterior wall of the retention ring and is configured to engage the elastomeric matrix.

8. The method of claim 6, wherein the transverse projection extends from the interior wall of the retention ring and is configured to engage a bristle tuft received by the retention ring.

* * * * *